US006694578B1

(12) United States Patent
Nicoll

(10) Patent No.: US 6,694,578 B1
(45) Date of Patent: Feb. 24, 2004

(54) CHILD SAFETY BELT BUCKLE LOCKING MECHANISM

(76) Inventor: Kimberly A. Nicoll, 10 Morton Ave., Monroe Township, NJ (US) 08831

( * ) Notice: Subject to any disclaimer, the term of this patent is extended or adjusted under 35 U.S.C. 154(b) by 0 days.

(21) Appl. No.: 10/439,787

(22) Filed: May 15, 2003

(51) Int. Cl.[7] ..... A44B 11/26

(52) U.S. Cl. ..... 24/645; 24/642; 24/633; 24/647; 24/648; 24/650

(58) Field of Search ..... 24/645, 647, 648, 24/651, 657, 663, 633, 634, 639, 635, 642

(56) References Cited

U.S. PATENT DOCUMENTS

| | | | | | |
|---|---|---|---|---|---|
| 1,384,001 | A | * | 7/1921 | Splittstoesser | 24/645 |
| 3,789,467 | A | * | 2/1974 | Aratani et al. | 24/648 |
| 4,321,734 | A | * | 3/1982 | Gandelman | 24/648 |
| 4,575,908 | A | * | 3/1986 | Gloomis et al. | 24/650 |
| 4,624,033 | A | * | 11/1986 | Orton | 24/633 |
| 4,675,956 | A | * | 6/1987 | Cohen | 24/657 |
| 4,937,923 | A | * | 7/1990 | McEntire | 24/647 |
| 5,184,376 | A | * | 2/1993 | Hunter et al. | 24/633 |
| 5,442,840 | A | * | 8/1995 | Ewald | 24/633 |
| 5,907,892 | A | * | 6/1999 | Todd | 24/642 |

* cited by examiner

*Primary Examiner*—Victor Sakran

(57) ABSTRACT

A safety belt buckle locking mechanism comprising a receiving buckle and an insertion buckle with spring-loaded safety locking bars and side-pins extending from each side of the insertion buckle. The receiving buckle has an internal spring-action latch rotatively attached to pivot pin and a spring-loaded main belt release button extending from the top of the buckle. The insertion buckle has a rectangular latching hole, which the receiving buckle's latch snaps into when the two buckles are coupled together. When the belt release button is pressed downward, the spring-action latch is rotated upward out of the mating rectangular latching hole, thereby releasing the belts. To make it difficult for a child to unlatch the belts, two spring-loaded safety locking bars with extended side-pins are positioned directly below each side of the belt release button, so that the release button cannot be depressed until the two spring-loaded safety locking bars are simultaneously push inward, out from under the release button, by means of the locking side-pins, thereby making it extremely difficult for a baby to accomplish this task, although being quick and easy for a parent or other adult to accomplish.

20 Claims, 3 Drawing Sheets

CHILD SAFETY BELT BUCKLE LOCKING MECHANISM

BACKGROUND OF THE INVENTION

1. Field of the Invention

The present invention relates to safety belts for use with children in connection with car seats, strollers, shopping carts, etc. The child safety belt buckle locking mechanism has particular utility in connection with preventing a baby from accidentally unlocking his/her seat belt and thereby creating a safety hazard.

2. Description of the Prior Art

We are all sensitive to the fact that babies need to be buckled up when riding or otherwise sitting in a car seat, stroller, shopping cart, or the like to avoid possible serious injury. However, even small babies can sometimes find a way to operate seemingly complicated devices for them, such as unlatching their seat belt. It would be desirable to have a child's seat belt buckle locking mechanism that would be practically impossible for a baby to unlatch, while at the same time is quick and easy for an adult to operate.

The use of seatbelt locking mechanisms is known in the prior art. For example, U.S. Pat. No. 5,907,892 to Todd discloses a child safety apparatus for a seat belt buckle, which has a pushbutton interlock mechanism that when activated, prevents the seatbelt's main release button from being released. However, although the Todd '892 patent has a similar function, the structure is different from that of the present invention and does not require two-hand operation, as does the present invention, thereby making it very difficult for a small child to operate the mechanism.

U.S. Pat. No. 4,575,908 to Gloomis et al. discloses a lock for seat belt buckle that has a slidable locking member that can be manually moved to a locking position to block the depression of the main seatbelt release button. However, although the Gloomis '908 patent has a similar function, the structure is different from that of the present invention and it does not require two-hand operation, as does the present invention, thereby making it very difficult for a small child to operate the mechanism.

Similarly, U.S. Pat. No. 5,184,376 to Hunter et al. discloses a child-resistant safety belt buckle that uses a spring-loaded rotatable or pushbutton member mounted on the top skirt of the buckle to prevent the release of the belt mechanism. However, although the Hunter '376 patent has a similar function, the structure is different from that of the present invention, which requires that two spring loaded buttons be pressed and held in with one hand while the main release button is pressed.

Lastly, U.S. Pat. Nos. 5,442,840 to Ewald, 4,624,033 to Orton, and D359,709 to Miller disclose apparatus that may be of general interest and pertinent to the construction and design of the present invention. The Ewald '840 and Orton '033 patents disclose a sheath and housing, respectively, that slides over the buckle to prevent a child from pressing the belt's main release button. Finally, the Miller '709 design patent discloses the design for a childproof seatbelt lock. However, all of these patents disclose apparatus that is different in structure from that of the present invention and none of them requires two-hand operation, as does the present invention, thereby making it very difficult for a small child to operate the mechanism.

While the above-described devices fulfill their respective, particular objectives and requirements, the aforementioned patents do not describe a child safety belt buckle locking mechanism that has the structure of the present invention and requires two-hand operation, as does the present invention, thereby making it very difficult for a small child to operate the mechanism.

Therefore, a need exists for a new and improved seatbelt buckle safety device that can be easily operated by an adult, but is practically impossible for small child or baby to operate. In this regard, the present invention substantially fulfills this need. In this respect, the child safety belt buckle locking mechanism according to the present invention substantially departs from the conventional concepts and designs of the prior art, and in doing so provides an apparatus primarily developed for the purpose of preventing a small child from accidentally unlatching a seat belt buckle.

SUMMARY OF THE INVENTION

In view of the foregoing disadvantages inherent in the known types of child seatbelt safety devices now present in the prior art, the present invention provides an improved child safety belt buckle locking mechanism, and overcomes the above-mentioned disadvantages and drawbacks of the prior art. As such, the general purpose of the present invention, which will be described subsequently in greater detail, is to provide a new and improved child safety belt buckle locking mechanism and method which has all the advantages of the prior art mentioned heretofore and many novel features that result in a child safety belt buckle locking mechanism that is not anticipated, rendered obvious, suggested, or even implied by the prior art, either alone or in any combination thereof.

The safety belt buckle locking mechanism of the present invention is easy for an adult, but very difficult for a baby, to operate. The mechanism can be used with any safety belt arrangement, whether manufactured on a product or retrofitted on existing products.

To attain this, the present invention essentially comprises a receiving buckle and an insertion buckle, with two spring-loaded safety locking bars and side-pins, one extending from each side of the insertion buckle. The receiving buckle has an internal spring-action latch rotatively attached to pivot pin and a spring-loaded main belt release button extending from the top of the buckle. The insertion buckle has a rectangular latching hole, which the receiving buckle's latch snaps into when the two buckles are coupled together. When the belt release button is pressed downward, the spring-action latch is rotated upward out of the mating latching hole, thereby releasing the buckles. However, to make it difficult for a small child to unlatch the belts, the present invention uses the two spring-loaded safety locking bars attached to side-pins, which are normally positioned directly below the rim on each side of the main belt release button, so that the main belt release button cannot be depressed until the two spring-loaded safety locking bars are simultaneously push inward, out from under the release button rim, by means of the locking side-pins.

Operation of the mechanism typically requires the use of both hands, one hand to hold the two locking side-pins in so as to move the attached safety locking bars out of the way, and the other hand to push the main belt release button to unlatch the buckles. As soon as the locking side-pins are released, compressed spring action returns them to their normal locking positions, thereby again making it impossible to press the release button. Since this action requires that two spring-loaded side pins be pressed in and held simultaneously while the main belt release button is pressed, it would be extremely difficult for a baby or small child to accomplish this task, although it is quick and easy for an adult to operate.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new child safety belt buckle locking mechanism that provides in the apparatuses and methods of the prior art some of the advantages thereof, while simultaneously overcoming some of the disadvantages normally associated therewith.

It is another object of the present invention to provide a new and improved child safety belt buckle locking mechanism that may be easily and efficiently manufactured and marketed.

It is an even further object of the present invention is to provide a new and improved child safety belt buckle locking mechanism that has a low cost of manufacture with regard to both materials and labor, and which accordingly is then susceptible of low prices of sale to the consuming public, thereby making such devices economically available to the buying public.

Lastly, it is an object of the present invention to provide a new and improved child safety belt buckle locking mechanism that can be included in production units or provided as an after market product.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
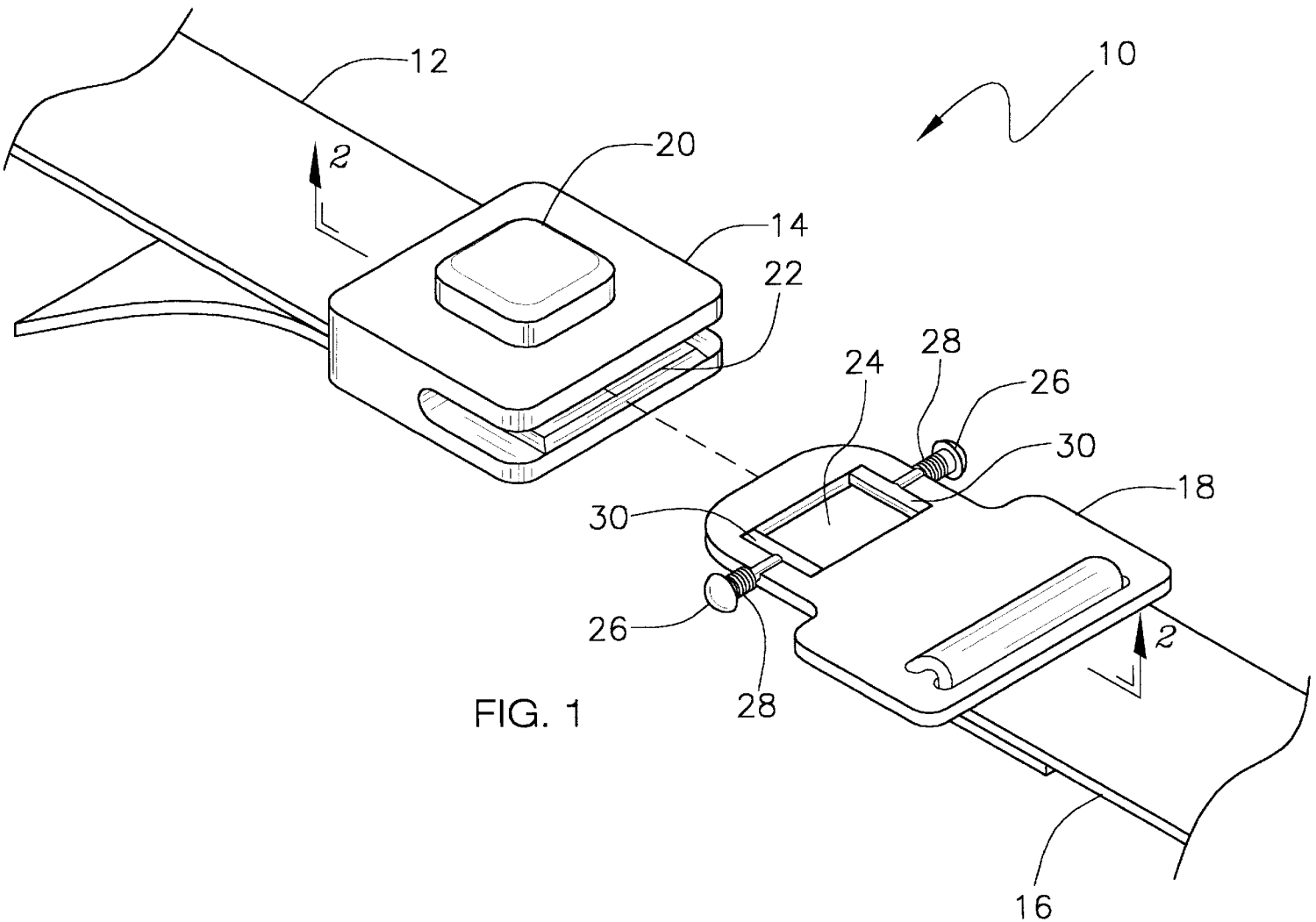
FIG. 1 is a perspective view of the preferred embodiment of the child safety belt buckle locking mechanism constructed in accordance with the principles of the present invention.

Referring now to the drawings, and particularly to FIGS. 1–4, a preferred embodiment of the child safety belt buckle locking mechanism of the present invention is shown and generally designated by the reference numeral 10.

In FIG. 1, a new and improved child safety belt buckle locking mechanism 10 of the present invention for securing a baby or small child safely in a car seat is illustrated and will be described. More particularly, the child safety belt buckle locking mechanism 10 has a receiving buckle 14 attached to a first portion of a seat belt 12 and an insertion buckle 18 attached to a second portion of a seat belt 16. The receiving buckle 14 has an insertion slot 22 for receiving the tongue of the insertion buckle and a spring-loaded main belt release button 20 for use in releasing the belts. The insertion buckle 18 has a rectangular latching hole 24 sized to interface with a spring-action latch internal to the receiving buckle 14. Extending outward from each side of the insertion buckle 18, adjacent the rectangular latching hole 24, are safety locking side-pins 26, which are also spring-loaded 28 and attached to safety locking bars 30 positioned inside the rectangular latching hole 24.

Figure 2:
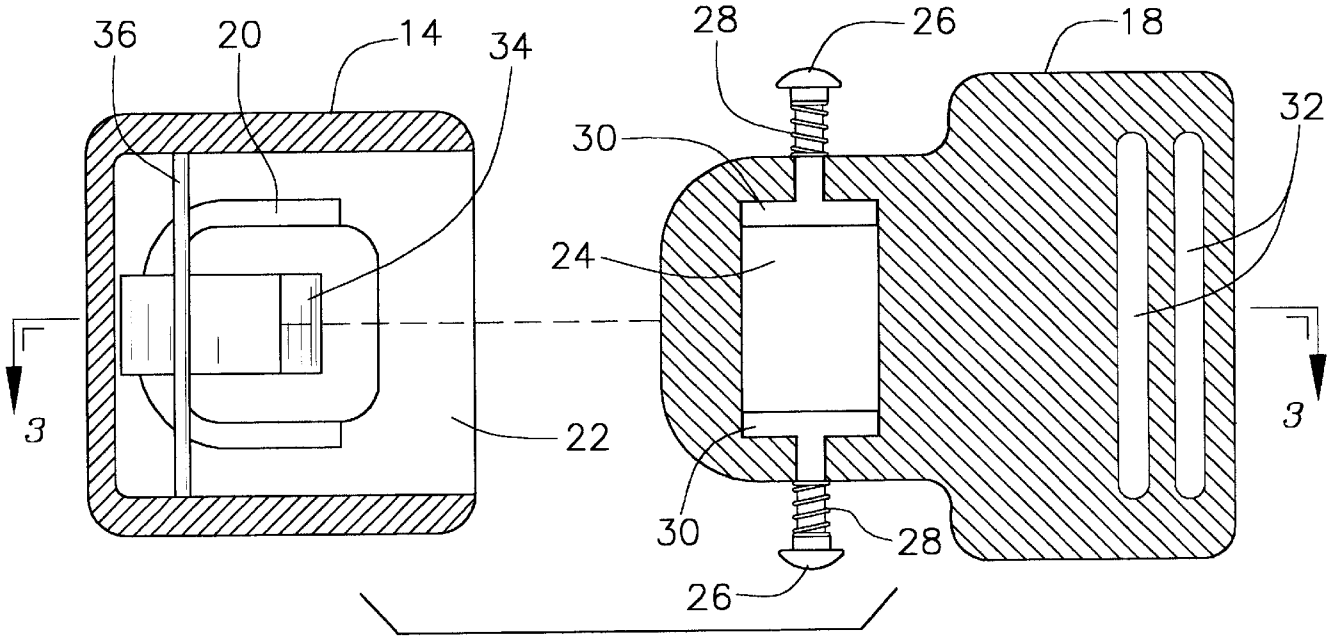
FIG. 2 is a bottom cross-sectional view of the child safety belt buckle locking mechanism of the present invention.
Figure 3:
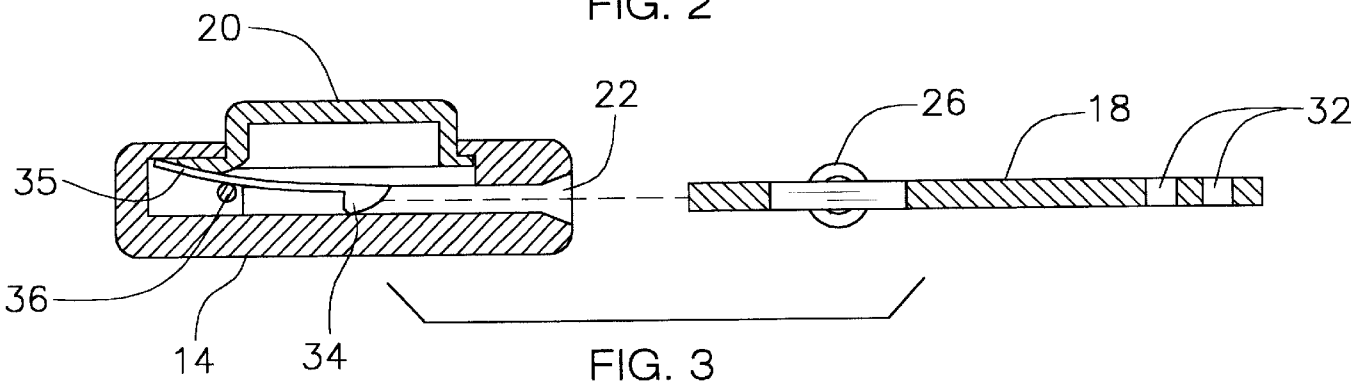
FIG. 3 is a side cross-sectional view of the child safety belt buckle locking mechanism of the present invention.

FIGS. 2 and 3 are bottom and side cross-sectional views, respectively, of the child safety belt buckle locking mechanism, which shows more details of the latching and safety locking mechanism of the present invention. This shows how the tongue portion of the inserting buckle 18 slips into the insertion slot 22 of the receiving buckle with the spring-action latch 34 snapping into the rectangular latching hole 24. The spring-action latch 34 is normally forced downward so that the end latch interlocks with the latching hole 24 and is rotated around a pivot rod 36 when the main belt release button 20 is pushed downward, thereby forcing the backend of the latch 35 down and the front latch end up out of the latching hole 24 to free the buckles.

The safety belt buckle locking mechanism is also shown with the safety locking bars 30 being forced to the outside of the latching hold 24 by the locking springs 28 mounted on the safety locking side-pins 26. Notice that the safety locking bars 30 align under the outside rim of the belt release button 20 when the buckles are engaged, thereby locking the main belt release button 20 so that it cannot be push downward to release the buckle. Also, belt attaching slots 32 are shown.

Figure 4:
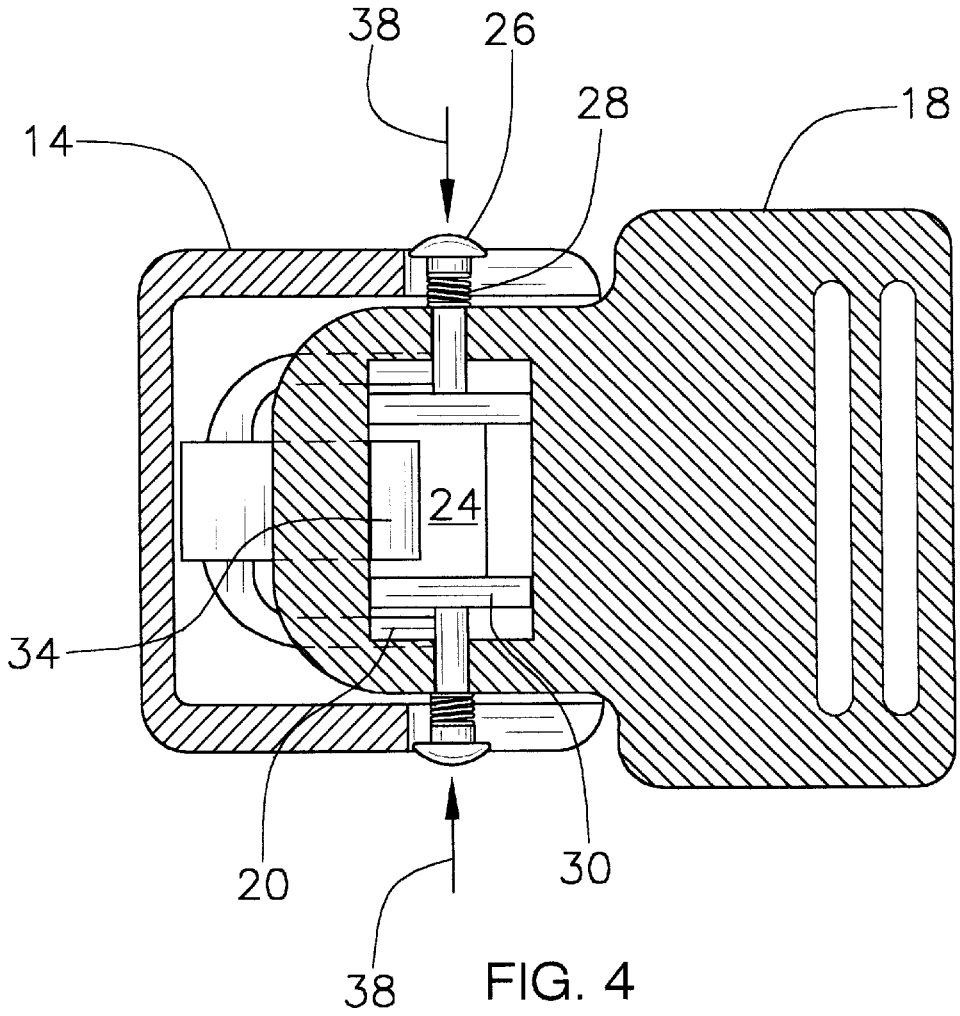
FIG. 4 is a top cross-sectional view of a latched child safety belt buckle locking mechanism of the present invention, showing the release safety buttons pushed inward to allow the main belt release button to be pressed downward for unlatching the buckles.

Finally, FIG. 4 is a top cross-sectional view of the child safety belt buckle locking mechanism of the present invention, showing latched buckles 14,18, with the spring-action latch 34 snapped into the rectangular latching hole 24. In the figure, the two safety locking side-pins 26 are shown depressed inward 38, compressing the springs 28, and moving the safety locking bars 30 out from under the rim of the main belt release button 20, thereby allowing the main belt release button 20 to be depressed and the buckles to be unlatched. As soon as the safety locking side-pins 26 are released, the locking bars 30 are forced back into their locking position by the springs 28.

In use, it can now be understood that operation of the safety belt buckle locking mechanism 10 typically requires the use of both hands, one hand to hold the locking side-pins 26 with attached safety locking bars 30 in, and the other hand to push the main belt release button 20 downward to unlatch the belts. As soon as the locking side-pins 26 are released, the springs 28 return them to their normal locking position, thereby making it impossible to press the release button 20. Since this action requires that two spring-loaded side pins 26 be pressed in and held simultaneously while the main belt release button is pressed, it would be extremely difficult for a baby or small child to accomplish this task, although it is quick and easy for an adult to operated.

While a preferred embodiment of the child safety belt buckle locking mechanism has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the safety locking mechanism can be used effectively with any seat belt or harness arrangement. Also, the mechanism can be made in larger sizes for use by adults to prevent inadvertent unlatching of a seatbelt when used in critical applications.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A safety belt buckle locking mechanism comprising:

a receiving buckle with latching means attached to a first portion of a seat belt;

an insertion buckle with rectangular latching hole attached to a second portion of a seat belt, said insertion buckle being coupled and latched to said receiving buckle;

a spring-loaded main belt release button extending from the top of said receiving buckle for releasing said latched receiving buckle from said insertion buckle;

a first spring-loaded safety locking side-pin extending through a first side of said insertion buckle into said rectangular latching hole;

a first safety locking bar positioned inside said rectangular latching hole, said first safety locking bar being attached to said first spring-loaded safety locking side-pin, said first safety locking bar normally positioned to align under a first side of said main belt release button, thereby preventing said main belt release button from being depressed to unlatch said insertion buckle from said receiving buckle;

a second spring-loaded safety locking side-pin extending through a second side of said insertion buckle into said rectangular latching hole; and a second safety locking bar positioned inside said rectangular latching hole, said second latching bar being attached to said second spring-loaded safety locking side-pin, said second safety locking bar normally positioned to align under a second side of said main belt release button, thereby further preventing said main belt release button from being depressed to unlatch said insertion buckle from said receiving buckle.

2. The mechanism of claim 1, said latching means further comprising a spring-action latch rotatively mounted inside said receiving buckle to a pivot rod, said latch being rotated upward out of said rectangular latching hole when said main belt release button is depressed to force the backend of said latch downward, said latch further being returned to a normal position by said spring loaded means when said main belt release button is released.

3. The mechanism of claim 1, wherein said first and second portions of said seat belts are adjustably attached to said receiving buckle and said insertion buckle, respectively.

4. The mechanism of claim 1, wherein said buckle parts are fabricated out of metal.

5. The mechanism of claim 1, wherein said first and second safety locking bars are fabricated from material from the group comprised of: metal and hard plastic.

6. The mechanism of claim 1, wherein said safety belts are fabricated from material from the group comprised of: nylon and insoluble polymers.

7. The mechanism of claim 1, wherein said first and second spring-loaded safety locking side-pins are simultaneously pushed inward with one hand to move said first and second safety locking bars from underneath said main belt release button, thereby freeing said main belt release button to be depressed to unlatch the said buckles.

8. The mechanism of claim 7, wherein said first and second spring-loaded safety locking side-pins springably return to a locking position under said main belt release button when released.

9. As baby seat with safety belt buckle locking mechanism, comprising:

a baby seat;

seat belts attached to each side of said baby seat for securing a baby in said seat, said seat belts having a built-in safety belt buckle locking mechanism to prevent a baby from inadvertently unlatching said belts, said safety belt buckle locking mechanism further comprising:

a receiving buckle with latching means attached to a first portion of a seat belt;

an insertion buckle with rectangular latching hole attached to a second portion of a seat belt, said insertion buckle being coupled and latched to said receiving buckle;

a spring-loaded main belt release button extending from the top of said receiving buckle for releasing said latched receiving buckle from said insertion buckle;

a first spring-loaded safety locking side-pin extending through a first side of said insertion buckle into said rectangular latching hole;

a first safety locking bar positioned inside said rectangular latching hole, said first safety locking bar being attached to said first spring-loaded safety locking side-pin, said first safety locking bar normally positioned to align under a first side of said main belt release button, thereby preventing said main belt release button from being depressed to unlatch said insertion buckle from said receiving buckle;

a second spring-loaded safety locking side-pin extending through a second side of said insertion buckle into said rectangular latching hole; and a second safety locking bar positioned inside said rectangular latching hole, said second latching bar being attached to said second spring-loaded safety locking side-pin, said second safety locking bar normally positioned to align under a second side of said main belt release button, thereby further preventing said main belt release button from being depressed to unlatch said insertion buckle from said receiving buckle.

10. The baby seat of claim 9, said latching means further comprising a spring-action latch rotatively mounted inside said receiving buckle to a pivot rod, said latch being rotated upward out of said rectangular latching hole when said main belt release button is depressed to force the backend of said latch downward, said latch further being returned to a normal position by said spring loaded means when said main belt release button is released.

11. The baby seat of claim 9, wherein said first and second portions of said seat belts are adjustably attached to said receiving buckle and said insertion buckle, respectively.

12. The baby seat of claim 9, wherein said buckle parts are fabricated out of metal.

13. The baby seat of claim 9, wherein said safety locking bars are fabricated from material from the group comprised of: metal and hard plastic.

14. The baby seat of claim 9, wherein said safety belts are fabricated from material from the group comprised of: nylon and insoluble polymers.

15. The baby seat of claim 9, wherein said baby seat is fabricated from materials from the group comprised of: nylon and insoluble polymers.

16. The baby seat of claim 9, wherein said first and second spring-loaded safety locking side-pins are simultaneously pushed inward with one hand to move said first and second safety locking bars from underneath said main belt release button, thereby freeing said main belt release button to be depressed to unlatch the said buckles.

17. The baby seat of claim 16, wherein said first and second spring-loaded safety locking side-pins springably return to a locking position under said main belt release button when released.

18. A baby seat with safety belt buckle locking mechanism, comprising:

a baby seat, said baby seat being made of a polymer type material;

nylon type seat belts adjustably attached to each side of said baby seat for securing a baby in said seat, said seat belts having a built-in safety belt buckle locking mechanism to prevent a baby from inadvertently unlatching said belts, said safety belt buckle locking mechanism further comprising:

a metal receiving buckle with latching means attached to a first portion of a seat belt, said latching means further comprising a spring-action latch rotatively mounted inside said receiving buckle, said spring-action latch rotatively attached to a pivot rod by spring loading means, said latch being rotated upward when said main belt release button is depressed, to push the backend of said latch downward, said latch further being forced downward in normal position by said spring loaded means when said main belt release button is released;

a metal insertion buckle with rectangular latching hole attached to a second portion of a seat belt, said insertion buckle being coupled and latched to said receiving buckle;

a spring-loaded main belt release button extending from the top of said receiving buckle for releasing said latched receiving buckle from said insertion buckle;

a first spring-loaded safety locking side-pin extending through a first side of said insertion buckle into said rectangular latching hole;

a first metal safety locking bar positioned inside said rectangular latching hole, said first safety locking bar being attached to said first spring-loaded safety locking side-pin, said first safety locking bar normally positioned to align under a first side of said main belt release button, thereby preventing said main belt release button from being depressed to unlatch said insertion buckle from said receiving buckle;

a second spring-loaded safety locking side-pin extending through a second side of said insertion buckle into said rectangular latching hole; and a second metal safety locking bar positioned inside said rectangular latching hole, said second latching bar being attached to said second spring-loaded safety locking side-pin, said second safety locking bar normally positioned to align under a second side of said main belt release button, thereby further preventing said main belt release button from being depressed to unlatch said insertion buckle from said receiving buckle.

19. The baby seat of claim 18, wherein said first and second spring-loaded safety locking side-pins are simultaneously pushed inward with one hand to move said first and second safety locking bars from underneath said main belt release button, thereby freeing said main belt release button to be depressed to unlatch the said buckles.

20. The baby seat of claim 19, wherein said first and second spring-loaded safety locking side-pins springably return to a locking position under said main belt release button when released.

* * * * *